US007154494B2

(12) United States Patent
Kato et al.

(10) Patent No.: US 7,154,494 B2
(45) Date of Patent: Dec. 26, 2006

(54) METHOD AND DEVICE FOR DRIVING AN ORGANIC EL DISPLAY DEVICE

(75) Inventors: Naoki Kato, Yokohama (JP); Tadakage Seki, Tokyo (JP)

(73) Assignee: Optrex Corporation, Tokyo (JP)

( * ) Notice: Subject to any disclaimer, the term of this patent is extended or adjusted under 35 U.S.C. 154(b) by 24 days.

(21) Appl. No.: 11/116,297

(22) Filed: Apr. 28, 2005

(65) Prior Publication Data

US 2005/0242747 A1 Nov. 3, 2005

(30) Foreign Application Priority Data

Apr. 28, 2004 (JP) ..... 2004-134107

(51) Int. Cl.
*G09G 5/00* (2006.01)

(52) U.S. Cl. ..... 345/212; 345/211; 345/82; 345/77

(58) Field of Classification Search ..... None
See application file for complete search history.

(56) References Cited

U.S. PATENT DOCUMENTS 6,313,821 B1 * 11/2001 Mizuno ..... 345/101
2004/0061670 A1 * 4/2004 Muruyama et al. ..... 345/76

* cited by examiner

*Primary Examiner*—Tuyet Thi Vo
(74) *Attorney, Agent, or Firm*—Oblon, Spivak, McClelland, Maier & Neustadt, P.C.

(57) ABSTRACT

Although the driving voltage of an organic EL element is gradually reduced (gradually decreases) as an ambient temperature increases, a supply voltage $V_{SEG}$, which is supplied to a data electrode driver, is controlled to so as to be kept at a higher value than the driving voltage of the organic EL element by about 6 V as a margin value for supply source in an intermediate temperature range (e.g., from 20 to 60° C.). In a high temperature range, the supply voltage $V_{SEG}$ is decreased, according to temperature rise, in a higher degree as the gradual decrease in the supply voltage $V_{SEG}$ in the intermediate temperature range.

8 Claims, 7 Drawing Sheets

AA: CROSS-TALK IS PERMISSIBLE

BB: DRIVER IS SUBJECTED TO VOLTAGE BEYOND LIMIT

CC: LARGE HEAT GENERATION

METHOD AND DEVICE FOR DRIVING AN ORGANIC EL DISPLAY DEVICE

BACKGROUND OF THE INVENTION

1. Field of the Invention

The present invention relates to a method and a device for driving an organic EL display device employing an organic electroluminescence light emitting element (hereinbelow, referred to as organic EL element).

2. Description of the Related Art

Organic EL display devices, which employ an organic EL panel having a structure that respective organic EL elements are disposed at respective pixels of matrix electrodes, have been realized. Such an organic EL panel comprises a substrate, such as a glass substrate, a plurality of anode strips (hereinbelow, referred to as the anode electrodes) disposed thereon and a plurality of cathode strips (hereinbelow, referred to as the cathode electrodes) disposed thereon so as to extend in a direction perpendicular to the anode electrodes, the anode electrodes comprising a transparent conductive layer, such as an ITO film, and being connected to an anode or forming an anode per se, the cathode electrodes comprising a metal film connected to a cathode or forming a cathode per se. The intersection between an anode electrode and a cathode electrode forms a pixel, and an organic thin film (organic EL element) is sandwiched between both electrode. Thus, pixels, each of which comprises an organic EL element, are disposed so as to have a matrix pattern in a planar fashion on the substrate.

An organic EL element has similar characteristics to a semiconductor light emitting diode. In other words, an organic EL element emits light when a certain voltage is applied across both electrodes to supply a current to the organic EL element in such a state that an anode side serves as a high voltage side. Specifically, when the difference between the potential on the anode side and the potential on the cathode side is beyond a turn-on-voltage, a current starts flowing through the organic EL element. Conversely, when the cathode side is placed at a high potential, the organic EL element emits no light since no almost current flows. For this reason, an organic EL element is called an organic LED in some cases.

An organic EL panel may be driven by passive matrix addressing. When an organic EL panel is driven, the anode electrodes and the cathode electrodes of the organic EL panel may be set as scanning electrodes or data electrodes. In other words, the anode electrodes and the cathode electrodes may serve as scanning electrodes and data electrodes, respectively, or the anode electrodes and the cathode electrodes may serve as data electrodes and scanning electrodes, respectively. Explanation will be made with respect to a case wherein the cathode electrodes and the anode electrodes serve as scanning electrodes and data electrodes, respectively. For this reason, the cathode electrodes will be called scanning electrodes, and the anode electrodes will be called data electrodes.

When an organic EL panel may be driven by passive matrix addressing, the scanning electrodes are connected to a scanning electrode driver with a constant-voltage circuit, providing the scanning electrodes with constant-voltage drive. The scanning electrodes are sequentially scanned so that one of the scanning electrodes is put in a selected state with a selection voltage applied, and the remaining scanning electrodes are put in a non-selected state without the selection voltage applied. In general, scanning is sequentially performed so that a selection voltage is applied to a scanning electrode in each selection period, starting from an endmost one of the scanning electrode and ending at the other endmost one of the scanning electrodes. All scanning electrodes are scanned in a certain period of time to apply a certain driving voltage to a selected pixel.

On the other hand, the data electrodes are connected to a data electrode driver with a constant-current circuit (constant-current source). A display data that corresponds to a display pattern of selected scanning electrodes is supplied to all data electrodes in synchronization with scanning. A current pulse that has been supplied to the data electrodes from the constant-current circuit flows into a selected scanning electrode through the organic EL element disposed at the intersection between the selected scanning electrode and the opposing data electrode.

A pixel comprising an organic EL element emits light only during a period of time wherein the scanning electrode connected to the pixel is selected while a current is supplied to the pixel from the opposed data electrode. When supply of the current from the data electrode is stopped, light emission is also stopped. All scanning electrodes are sequentially and repeatedly scanned by supplying a current to organic EL elements sandwiched between the data electrodes and the scanning electrodes in this way. In accordance with a desired display pattern, the emission and the non-emission of light is controlled with respect to the pixels in the entire display screen.

The scanning electrode driver sets the potential of a selected scanning electrode at a lower level than that of a non-selected scanning electrode. It is assumed that the potential of a selected scanning electrode is a selection voltage $V_{COML}$ and that the potential of a non-selected scanning electrode is a non-selection voltage $V_{COMH}$. In most of cases, ground potential is utilized as the selection voltage $V_{COML}$. Data electrodes that contain no pixels to emit light in a selected row are set at a certain potential (hereinbelow, referred to as $V_{CL}$). The potential $V_{CL}$ is set so that the difference ($V_{CL}-V_{COML}$) between the potential $V_{CL}$ and the selection voltage $V_{COML}$ is lower than the turn-on-voltage. In most of cases, the potential $V_{CL}$ is set at ground potential. The data driver also sets the potential of data electrodes that contain pixels to emit light in a selected row, and a current flows from such data electrodes into a selected scanning electrode. The potential of such data electrodes is set so as to flow a constant current. However, it is not allowable to set the potential of the data electrodes at a higher level than the supply voltage $V_{SEG}$ of the constant-current circuit. An array of pixels, which extends in parallel with the scanning electrodes is called a "row" while an array of pixels, which extends in parallel with the data electrodes, is called a "column".

An organic EL element has temperature characteristics wherein the turn-on-voltage lowers as the temperature increases. In some cases, temperature compensation is made so as to reduce power consumption in the data electrode driver by lowering the supply voltage $V_{SEG}$ at a high temperature (see, e.g., JP-A-2003-150113, paragraphs 0023 to 0026, and FIGS. 1 and 3).

FIG. 11 is a block diagram showing the drive circuit of a conventional organic EL display device described in the reference stated earlier. In the structure shown in FIG. 11, a plurality of data electrodes 110 and a plurality of scanning electrodes 111 are disposed so as to be perpendicular to each other in an organic EL panel 101. Each organic EL element is shown as a diode. A scanning electrode driver 102 includes a scanning switch with respect to each of the scanning electrodes 111, the scanning switches providing scanning electrodes with either one of ground potential as the selection voltage $V_{COML}$ and a reverse-bias voltage (non-selection voltage) generated by a second temperature compensation circuit 106.

A data driver 103 includes a constant-current circuit and a driving switch with respect to each of the data electrodes 110, the constant-current circuit introducing a supply voltage $V_{SEG}$ from a supply circuit 105*b* and supplying a constant current to the relevant data electrode, and the driving switch putting the relevant data electrode 110 in either one of a supply state to supply a current to the relevant data electrode 110 from the relevant constant-current circuit and a non-supply state to supply no current to the relevant data electrode from the relevant constant-current circuit. A controller 104 not only controls the scanning electrode driver 102 so as to sequentially apply the selection voltage $V_{COML}$ to the respective scanning electrodes 111 but also outputs a data to the data electrode driver 103, the data corresponding to pixels in a row relevant to a scanning electrode 111 with the selection voltage $V_{COML}$ applied thereto. The data electrode driver 103 determines the respective states of the drive switches according to an input data.

The supply circuit 105*b* receives, from a temperature detecting means 105*a* comprising a thermistor, a signal in response to the ambient temperature of the organic EL elements. The supply circuit 105*b* generates the supply voltage $V_{SEG}$ at a level in response to the ambient temperature of the organic EL elements and applies the supply voltage as the driving voltage to organic EL elements through the data electrode driver 103. The temperature detecting means 105*a* and the supply circuit 105*b* form a first temperature compensation circuit 105. The second temperature compensation circuit 106 introduces the supply voltage $V_{SEG}$ from the supply circuit 105*b*, generates the non-selection voltage $V_{COMH}$ at a lower level than the value of the supply voltage $V_{SEG}$ by a certain amount, and supplies the $V_{COMH}$ to the scanning electrode driver 102.

FIG. 12 is a schematic view showing a relationship between an ambient temperature, a supply voltage $V_{SEG}$ (corresponding to T1 in this figure) and a non-selection voltage $V_{COMH}$ (corresponding to T2 in this figure) described in the reference stated earlier. In FIG. 12, the horizontal axis represents a temperature (° C.), and the vertical axis represents a voltage (V) Based on an ambient temperature of the organic EL elements detected by the temperature detecting means 105*a*, the supply circuit 105*b* lowers the supply voltage $V_{SEG}$ as the ambient temperature increases, which is shown in FIG. 12. The second temperature compensation circuit 106 sets the non-selection voltage $V_{COMH}$ at a voltage that is lower than the supply voltage $V_{SEG}$ by a certain offset amount×(3V in the example shown in FIG. 12).

In the reference stated earlier, it is described that by lowering the supply voltage $V_{SEG}$ as the ambient temperature increases, the supply voltage $V_{SEG}$ is prevented from being supplied to the data electrode driver 103 at an unnecessarily high level at a high ambient temperature, avoiding an increase in the consumption power of the data electrode driver 103. It is also described that by lowering the non-selection voltage $V_{COMH}$ as the ambient temperature increases, an organic EL element is prevented from emitting light in a non-selected state (when the non-selection voltage $V_{COMH}$ is applied to the scanning electrode 111 of the organic EL element) because of a decrease in the turn-on-voltage of the organic EL element caused by an increase in the ambient temperature.

BRIEF SUMMARY OF THE INVENTION

In most of cases, the data electrode driver 103 is configured as a single chip driver IC. The driver IC includes the supply circuit 105*b* and the scanning electrode driver 102 in some cases. In general, the driver IC has the maximum permissible voltage (breakdown voltage) and the maximum permissible temperature. For this reason, when an attempt is made to set the supply voltage $V_{SEG}$ at an optimum value in response to the ambient temperature as shown in FIG. 12, there is a possibility that the supply voltage $V_{SEG}$ supplied to the driver IC is beyond the breakdown voltage of the drive IC in a case wherein the ambient temperature is as low as, e.g., −30° C. In a case wherein the ambient temperature is as high as, e.g., 70° C., there is a possibility that malfunction or breakdown occurs since the temperature of the driver IC is beyond the maximum permissible temperature by a combination of the ambient temperature and heat generation of the driver IC per se.

In a case wherein an organic EL panel having high luminance is driven, the supply voltage $V_{SEG}$ is generally required to be set at a higher level than a case wherein an organic EL panel having monochrometic display is driven. For this reason, in a case wherein an organic EL panel having high luminance is driven, there is a possibility that the supply voltage $V_{SEG}$ is beyond the breakdown voltage of the driver IC when the ambient temperature is low, and that the temperature of the driver IC is beyond the maximum permissible temperature when the ambient temperature is high.

The data electrode driver 103 also sets the potential of data electrodes having pixels to emit light in a selected row, which has not been referred to in the reference stated earlier. It is not allowable to set the potential of the data electrodes at a higher level than the supply voltage $V_{SEG}$. In order that a current flows from a data electrode 110 into scanning electrodes 111 to cause the selected pixels to emit light, it is necessary to charge the capacitance of the selected pixels existing on that data electrode 110 to apply a voltage capable of flowing a constant current through the selected pixels in the selected row. At that time, first, a state with electric charges accumulated is removed by, e.g., application of a reverse-bias voltage. Additionally, by charging the capacitance of the selected pixels, the potential of data electrodes 110 is placed at the potential for flowing the constant current through the selected pixels in the selected row. As explained, charging is necessary until the required potential has been risen. If it takes much time to complete charging, the rise of the voltage applied to pixels to emit light is delayed. In order to avoid a delay in a rising speed for light emission, JP-A-9-232074 has proposed a driving method wherein when selected rows are switched, the next row is selected after all scanning electrodes 111 are connected to a reset voltage having the same potential once.

In the organic EL panel 101, when the respective rows are scanned to cause all pixels to emit light, the current that flows into a selected scanning electrode 111 becomes larger in proportion to the number of data electrodes. When the number of data electrodes is large, it is necessary to increase the length of the respective scanning electrodes 111 accordingly, which means that the resistance from one end to the other end of a scanning electrode 111 increases. Additionally, not only the scanning electrodes 111 but also scanning electrode lead wires as wiring from the scanning electrode driver 102 to the scanning electrodes 111 have resistance. By the presence of such resistance, the potential of a scanning electrode 111 selected by the scanning electrode driver 102 is higher than the original voltage of the selection voltage $V_{COML}$ (e.g., ground potential) in some cases.

In such a case, the constant-current circuits in the data electrode driver 103 need to flow the constant current, increasing the potential of the data electrodes 110 by an increase in the potential of the scanning electrode 111 in a selected row. However, when an increase in the potential of a scanning electrode 111 is large, the potential of the data electrodes 110 is brought close to the supply voltage $V_{SEG}$. When the driving capacity of the constant-current circuit is saturated, it is impossible to increase the potential of the data electrodes 110 in a satisfactory way. In such a case, no current flows through a pixel to emit light, failing to obtain desired light-emission luminance. In other words, in a row containing a large number of pixels to emit light, light-emission luminance lowers, causing striped chrominance non-uniformity (i.e., horizontal cross-talk, hereinbelow, referred to as "cross-talk"). When an organic EL panel having high luminance is driven, cross-talk appears more noticeably since the amount of a current is large. From this viewpoint, it is preferred that the supply voltage $V_{SEG}$ on the side of the data electrode driver 103 be maintained at a higher value than the driving voltage by some degree.

FIG. 13 is a schematic view showing an example of the method for controlling the supply voltage $V_{SEG}$ in response to variations in the ambient temperature of the organic EL panel 101 than a data electrode driver IC having a breakdown voltage of 20 V and a maximum permissible temperature of 125° C. is employed. In FIG. 13, the horizontal axis represents a temperature (° C.), and the vertical axis represents a voltage (V). It is assumed that the driving voltage of an organic EL element varies according to temperature variations as illustratively shown in FIG. 13, and that the supply voltage $V_{SEG}$ is controlled to be maintained at a higher voltage than the driving voltage by about 6 V. Under the circumstances, there is a possibility that malfunction or breakdown occurs at a temperature of not higher than −20° C. This is because a voltage, which is not lower than 20 V as the breakdown voltage, is applied to the data electrode driver IC. There is also a possibility that malfunction or breakdown occurs at a temperature of not lower than, e.g., 70° C. This is because the data electrode deriver IC per se generates heat to increase the temperature of the data electrode driver IC to a value beyond the maximum permissible temperature. Specifically, since the heat generation of the data electrode driver IC increases when the difference between the supply voltage $V_{SEG}$ and the driving voltage is large, and when the amount of a current is large, there is a good possibility that malfunction or breakdown occurs.

There is a possibility that in particular an organic EL device employed in a vehicle-borne device, such as a car audio system or an instrument panel, is placed in a high temperature environment. When such a vehicle-borne device is started in a high temperature environment, there is a possibility that the vehicle-borne device is activated improperly because of malfunction or breakdown of the driver IC.

For example, in order to prevent a driver IC from causing malfunction or breakdown in the range from −20° C. to +80° C., the supply voltage $V_{SEG}$, which is set so as to be 20 V when being subjected to −20° C., may be controlled so as to change along a curve representing the driving voltage as indicated by a dotted line in FIG. 13. However, such control causes strong cross-talk since the difference between the supply voltage $V_{SEG}$ and the driving voltage is decreased in the entire temperature range (from −20° C. to +80° C.)

From this viewpoint, it is an object of the present invention to provide a method and a device for driving an organic EL display device, which are capable of minimizing the generation of cross-talk according to ambient temperature charges of the organic EL panel while the temperature of the driving circuit is prevented from being beyond the maximum permissible temperature at a high temperature. It is another object of the present invention to provide a method and a device for driving an organic EL displace device, which are capable of minimizing the generation of cross-talk while the supply voltage is prevented from being beyond the breakdown voltage of the driving circuit at a low temperature.

According to a first aspect of the present invention, there is provided a method for driving an organic EL display device, comprising employing an organic EL panel including scanning electrodes and data electrodes so as to have a matrix pattern, the organic EL panel having an organic EL element sandwiched between a scanning electrode and a data electrode, setting a selected scanning electrode at a potential in a selection period, setting a non-selected scanning electrode at a potential in a non-selection period, and flowing a constant current from a data electrode driver into a data electrode containing a pixel to emit light; setting a voltage value of a supply voltage at a higher value than a driving voltage of the organic EL element by a margin value for power source, and changing the voltage value of the supply voltage according to changes in the driving voltage caused by changes in an ambient temperature of the organic EL panel, the power supply being supplied to the data electrode data driver, in a case wherein the ambient temperature is in an intermediate temperature range; and comprising setting the voltage value of the supply voltage so as to have a smaller difference between the supply voltage and the driving voltage than that in the intermediate temperature range, and changing the voltage value of the supply voltage in a higher degree than a changing degree in the supply voltage caused by the changes in the ambient temperature in the intermediate temperature range in a case wherein the ambient temperature is in a high temperature range which is higher than the intermediate temperature range.

According to a second aspect of the present invention, there is a method which further comprises controlling the voltage value of the supply voltage so as to gradually increase as the ambient temperature decreases and to prevent the voltage value of the supply voltage from further increasing when reaching a lower value than a breakdown voltage of the data electrode driver (e.g., 20 V or a value close thereto when the breakdown voltage is 20 V) in a case wherein the ambient temperature is in a low temperature range which is lower than the intermediate temperature range in the first aspect.

According to a third aspect of the present invention, there is provided a method which further comprises setting a boundary between the intermediate temperature range and the low temperature range in a range from −10 to +20° C. in the second aspect.

According to a fourth aspect of the present invention, there is provided a method which further comprising setting a boundary between the intermediate temperature range and the high temperature range in a range from +40 to +70° C. in the first, the second or the third aspect.

The driving method according to the present invention may be realized by employing a temperature-sensitive resistive element circuit comprising plural temperature-sensitive resistive elements, such as thermistors, in a supply circuit, which generates the supply voltage supplied to the data electrode driver. When such temperature-sensitive resistive elements are employed, the driving method stated earlier can be realized by properly selecting the characteristics of the temperature-sensitive resistive elements. In other words, the driving method according to the present invention can be realized in an adjustable range, which can be obtained by selecting the characteristics of the temperature-sensitive resistive elements.

According to a fifth aspect of the present invention, there is provided a device for driving an organic EL display device, wherein an organic EL panel including scanning electrodes and data electrodes are disposed so as to have a matrix pattern, is employed so as to have an organic EL element sandwiched between a scanning electrode and a data electrode, a selected scanning electrode is set at a potential in a selection period, a non-selected scanning electrode is set at a potential in a non-selection period, and a constant current is flowed from a data electrode driver into a data electrode containing a pixel to emit light; comprising a supply circuit, which employs a temperature-sensitive element circuit including at least two temperature-sensitive resistive elements having a resistance varying according to temperatures, and which provides the data electrode driver with a supply voltage, the supply voltage being generated so as to have a higher voltage value than a driving voltage of the organic EL element by a margin value for supply source and being changed according to variations in the driving voltage caused by changes in an ambient temperature of the organic EL element in a case wherein the ambient temperature is in an intermediate temperature range, and the supply voltage being generated so as to have the voltage value set at a smaller difference between the supply voltage and the driving voltage than that in the intermediate temperature range and have the voltage value changed in a higher degree than a changing degree in the supply voltage caused by the changes in the ambient temperature in the intermediate temperature range in a case wherein the ambient temperature is in a high temperature range which is higher than the intermediate temperature range.

According to a sixth aspect of the present invention, there is provided a driving device wherein the supply circuit is configured to gradually increase the voltage value of the supply voltage as the ambient temperature decreases and to prevent the voltage value of the supply voltage from further increasing when reaching a lower value than a breakdown voltage of the data electrode driver, the voltage value of the supply voltage being supplied to the data electrode driver, in a case wherein the organic EL panel has an ambient temperature in a low temperature range which is lower than the intermediate temperature range, in the fifth aspect.

According to a seventh aspect of the present invention, there is provided a driving device wherein the supply circuit further comprises a regulator circuit, which outputs the supply voltage supplied to the data electrode driver, and the temperature-sensitive resistive element circuit is disposed between an output side of the regulator circuit and a reference potential of the regulator circuit in order to determine an output voltage of the regulator circuit in the fifth or the sixth aspect.

According to an eighth aspect of the present invention, there is provided a driving method wherein a series combination of the temperature-sensitive resistive element circuit and a resistor having a fixed resistance is disposed between an output side of a switching regulator circuit as the regulator circuit and ground potential, and the temperature-sensitive resistive element circuit comprises a resistor having a fixed resistance, and at least two parallel combinations of a resister having a fixed resistance and a temperature-sensitive resistive element connected in series with one another in the seventh aspect.

In accordance with the driving method of the present invention, it is possible to suppress the generation of cross-talk in an intermediate temperature range according to ambient temperature changes of an EL panel while the temperature of the driving circuit is prevented from being beyond the maximum permissible temperature at a high temperature.

It is also possible to suppress the generation of cross-talk in an intermediate temperature range while the supply voltage is prevented from being beyond the breakdown voltage of the driving circuit at a low temperature.

DETAILED DESCRIPTION OF THE INVENTION

First Embodiment

Figure 1:
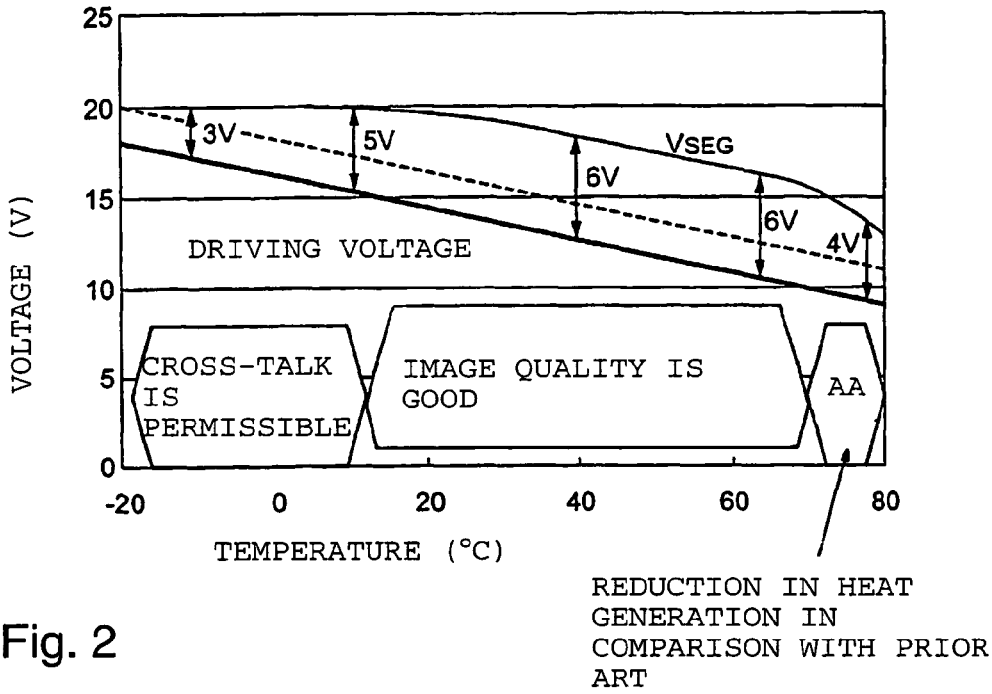
FIG. 1 is a schematic view explaining the concept of the present invention.

Now, embodiments of the present invention will be described, referring to the accompanying drawings. First, the concept of the present invention will be described, referring to FIG. 1. FIG. 1 is a schematic view showing an example of the method for controlling a supply voltage $V_{SEG}$ in response to variations in the ambient temperature (hereinbelow, referred to as "the temperature") of an organic EL panel when a data electrode driver IC having a breakdown voltage of 20 V is employed. In FIG. 1, the horizontal axis represents a temperature (° C.), and the vertical axis represents a voltage (V). Explanation will be made on a case wherein it is preferable to maintain the supply voltage $V_{SEG}$ at a higher value than the driving voltage by about 6 V as in the case shown in FIG. 13. The driving voltage is a voltage that is applied across the anode side and the cathode side of an organic EL element when the organic EL element is subjected to constant-current drive by a certain current.

The reason why it is preferable to maintain the supply voltage at a higher value than the driving voltage by about 6 V is that a driver overhead is estimated to be about 2 V and that the range of voltage variations in a panel is estimated to be about 4 V. The driver overhead and the voltage variation in the panel vary according to the characteristics, the size and the driving method (e.g. the amount of a current) of the organic EL panel. The driver overhead is the difference of the supply voltage $V_{SEG}$ with respect to the driving voltage (the driving voltage<the supply voltage $V_{SEG}$), which is required to stably flow a constant current by a constant-current circuit in the data electrode driver. The voltage variations in the panel are mainly an increment, by which the potential of a scanning electrode is higher than an original selection voltage $V_{COML}$ (e.g., ground potential). From this viewpoint, when the driver overhead and the voltage variations in the panel are expressed as a margin value for supply source, it is preferred that the supply voltage $V_{SEG}$ have a higher value than the driving voltage by at least the margin value for supply source. 2 V as the driver overhead is a value that is calculated when employing a commonly used driver IC. This value varies according to the characteristics of an employed driver IC or organic EL panel.

As shown in FIG. 1, the driving voltage of an organic EL element is gradually reducing (gradually decreasing) as the temperature increases. In accordance with the present invention, the supply voltage $V_{SEG}$, which is supplied to the data electrode driver, is controlled so as to have a higher value than the driving voltage of an organic EL element in an intermediate temperature range (e.g., from 20 to 60° C.) by the margin value for supply source. Accordingly, the supply voltage $V_{SEG}$ is gradually decreasing in substantially the same degree as the driving voltage is gradually decreasing in such an intermediate temperature range. Specifically, in FIG. 1, the inclination (gradient) of a curve representing the supply voltage $V_{SEG}$ is substantially the same as the inclination (gradient) of a curve representing the driving voltage in such an intermediate temperature range. In other words, when an organic EL panel has a temperature in such an intermediate range, the supply voltage $V_{SEG}$, which is supplied to the data electrode driver, is varied according to a degree of variation in the driving voltage caused by a temperature change, with the difference between the supply voltage and the driving voltage of the organic EL elements being a higher value by a certain margin value for supply source. Since such an intermediate temperature range contains, e.g., 25° C. as normal temperature, the intermediate temperature range will be referred to as the normal temperature range.

In a high temperature range, which is a range having a higher temperature than the normal temperature range, the supply voltage $V_{SEG}$ is lowered according to temperature increase by a higher degree than the supply voltage $V_{SEG}$ is gradually decreasing in the normal temperature range. In other words, when the temperature of an organic EL panel is higher than the normal temperature range, the supply voltage $V_{SEG}$, which is supplied to the data electrode driver, is varied by a higher degree than the supply voltage $V_{SEG}$ is varied according to temperature changes in the normal temperature range. From this viewpoint, in FIG. 1, the curve representing the supply voltage $V_{SEG}$ has a larger gradient in such a high temperature range than the normal temperature range.

Additionally, the supply voltage $V_{SEG}$, which is supplied to the data electrode driver, is controlled so as to be gradually increasing up to a breakdown voltage of 20 V as an upper limit according to temperature drop in a low temperature range, which is a range having lower temperatures than the normal temperature range. From this viewpoint, in FIG. 1, the curve representing the supply voltage $V_{SEG}$ has a gentler gradient in the normal temperature range than such a low temperature range, and when the supply voltage $V_{SEG}$ has reached 20 V, the supply voltage $V_{SEG}$ is kept constant even if the temperature further decreases. Although the boundary between the normal temperature range and the high temperature range, and the boundary between the normal temperature range and the low temperature range are, respectively, set at 60° C. and 20° C. in this embodiment, these boundaries may be varied according to the characteristics of an organic EL panel or an driver IC containing a data electrode driver. From this viewpoint, the boundary between the normal temperature range and the high temperature range may be set in the range from 40 to 70° C. for example, and the boundary between the normal temperature range and the low temperature range may be set in the range from −10 to 20° C. for example.

When the supply voltage $V_{SEG}$ is controlled as indicated by a solid curve in FIG. 1, cross-talk is caused in the lower temperature range and the high temperature range in some cases. However, no cross-talk is caused in the normal temperature range. In the high temperature range, the chances that malfunction or breakdown is caused in the data electrode driver are reduced since the supply voltage $V_{SEG}$ is greatly reduced to decrease the heat generation of the data electrode driver. Additionally, in the low temperature range, there is no possibility that the supply voltage $V_{SEG}$ is applied to the data electrode driver at a value of not less than the breakdown voltage.

Figure 13:
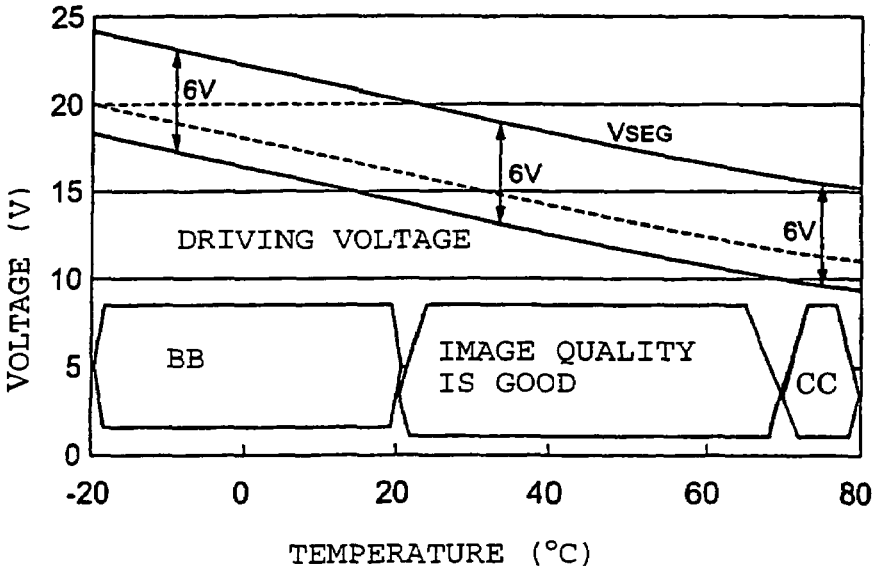
Fig. 13 PRIOR ART
FIG. 13 is a schematic view showing an example of the conventional method for controlling a supply voltage $V_{SEG}$ in response to variations in the temperature of an organic EL panel.

The dotted curve shown in FIG. 1 is a curve representing an example of the method for controlling the supply voltage $V_{SEG}$ according to the prior art, and shows the same state as the dotted curve shown in FIG. 13. Although it is possible to prevent malfunction or breakdown from being caused in the data electrode driver when the supply voltage $V_{SEG}$ is controlled as indicated by the dotted curve in FIG. 1, strong cross-talk is caused in the entire temperature range (from −20 to +80° C.) containing the normal temperature range. On the other hand, in accordance with the present invention, it is possible not only to reduce the generation of cross-talk in the entire temperature range (from −20 to +80° C.) but also to maintain good image quality without causing cross-talk, in particular, in the normal temperature range.

Figure 2:
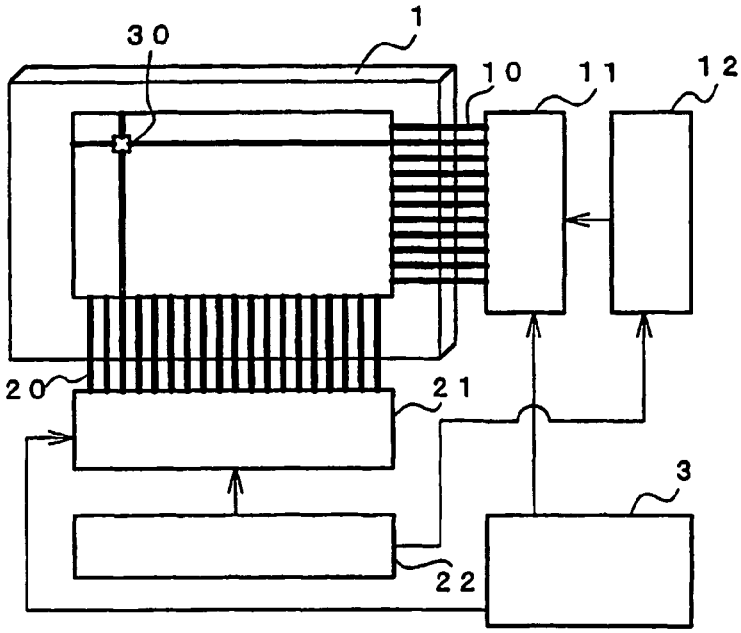
FIG. 2 is a block diagram showing a driving device along with an organic EL panel.

Now, a driving device for establishing the control of the supply voltage $V_{SEG}$ according to the present invention will be explained. FIG. 2 is a block diagram showing a driving device along with an organic EL panel 1 disposed on a substrate, such as a glass substrate. It is assumed that the driving device, which includes a scanning electrode driver 11, a data electrode driver 21 and a controller 3, and the organic EL panel 1 form an organic EL display device in this embodiment. The organic EL panel 1 includes a plurality of scanning electrodes 10 and a plurality of data electrodes 20, which are disposed so as to have a matrix pattern. For ease of explanation, lead wires are included in the scanning electrodes 10 or the data electrodes 20. Each of the scanning electrodes 10 and each of the data electrodes 20 are disposed so as to have an organic EL element 30 sandwiched therebetween, and the organic EL element 30 at the intersection between each of the scanning electrodes 10 and each of the data electrodes 20 serves as a pixel. Although only a single intersection is shown in FIG. 1, respective intersections serve as respective pixels. It is assumed that the scanning electrodes 10 are cathode electrodes, and that the data electrodes 20 are anode electrodes.

Each of the scanning electrode driver 11 and the data electrode driver 21 has a plurality of output terminals. The respective scanning electrodes 10 are connected to the respective output terminals of the scanning electrode driver 11 on one-to-one basis. Likewise, the respective data electrodes 20 are connected to the respective output terminals of the data electrode driver 21 on one-to-one basis. The controller 3 outputs control signals to the scanning electrode driver 11 and the data electrode driver 21 in order to control the scanning electrode driver 11 and the data electrode driver 21. The control signals output to the data electrode driver 21 contains a data signal.

Figure 11:
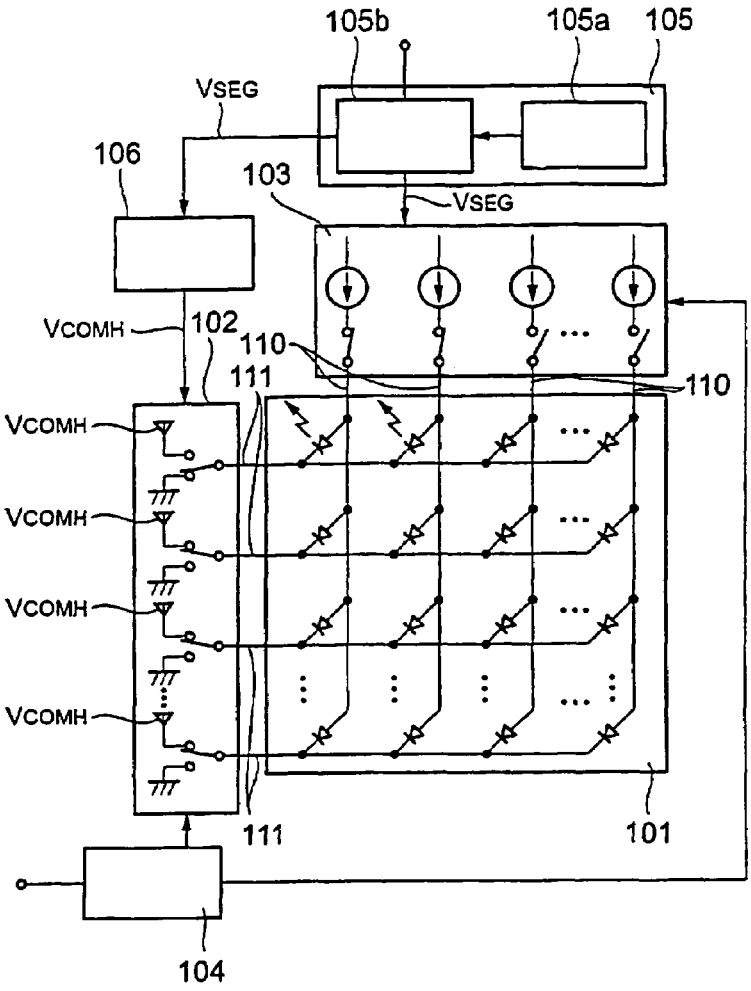
Fig. 11 PRIOR ART
FIG. 11 is a block diagram showing the driving device of a conventional organic EL display device.
Figure 12:
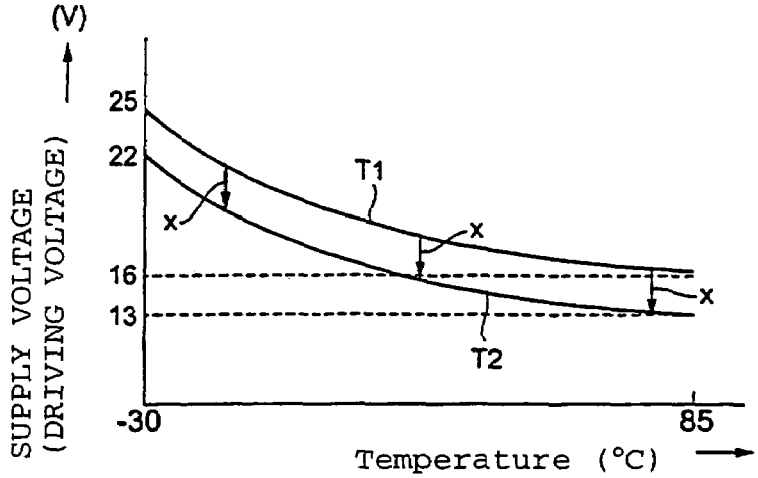
Fig. 12 PRIOR ART
FIG. 12 is a schematic view showing a relationship between a temperature, a supply voltage $V_{SEG}$ and a non-selection voltage $V_{COMH}$ in the conventional display device.

The supply voltage $V_{SEG}$, which is generated by a supply circuit in response to a temperature of the organic EL panel 1, is applied to the data electrode driver 21. As in the structure shown in FIG. 11, the data electrode driver includes a constant-current circuit (not shown in FIG. 2) for supplying a constant current to the relevant data electrode 20, and a driving switch (not shown in FIG. 2) for putting the relevant data electrode in either one of a supply state to supply the current from the relevant constant-current circuit and a non-supply state to supply no current to the relevant data electrode from the relevant constant-current circuit for each of the data electrodes 20. On the other hand, the scanning electrode driver 11 includes a scanning switch (not shown in FIG. 2) for each of the scanning electrodes 10, the scanning switch applying either one of a non-selection voltage $V_{COMH}$ and ground potential as a selection voltage $V_{COML}$ to the relevant scanning electrode 10, the non-selection voltage being generated by a supply circuit 12, which generates the non-selection voltage $V_{COMH}$ by reducing, by a certain amount, the value of the supply voltage $V_{SEG}$ generated by the supply circuit 22.

The scanning electrode driver 11 may be provided as a single chip LSI, and the data electrode driver 21 may also be provided as a single chip LSI. The scanning electrode driver 11 and the data electrode driver 21 may be combined in a single chip LSI.

Figure 3:
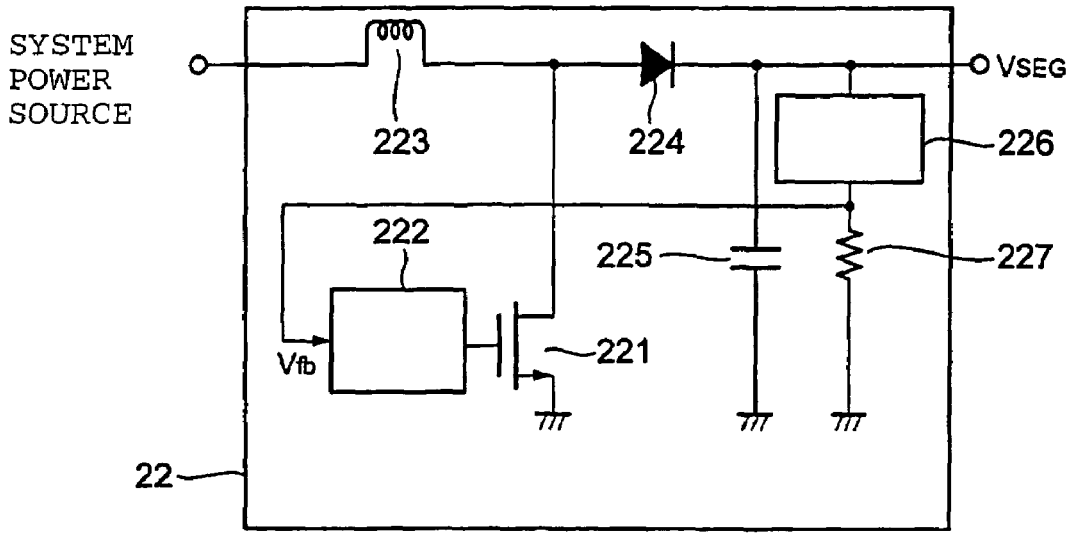
FIG. 3 is a block diagram showing an example of the structure of the supply circuit on a data electrode side.

FIG. 3 is a block diagram showing an example of the structure of the supply circuit 22. The structure illustratively shown in FIG. 3 employs a boost switching regulator, which has the voltage of a system power source input as an input voltage. The system power source is a power source in the device with the organic EL display device incorporated thereinto. The maximum value of the supply voltage $V_{SEG}$ as the output voltage from the supply circuit 22 is, e.g., 20 V, and the voltage of the system power source is, e.g., 12 V.

In the circuit shown in FIG. 3, power accumulated in a coil (inductor) 223 and power from the system power source side are superimposed and are output through a diode 224 and an output capacitor 225. The output voltage, which is employed as the supply voltage $V_{SEG}$ of the data electrode driver 21, is defined by (turn-on period+turn-off period)/turn-off period×input voltage of a transistor 221. The circuit shown in FIG. 3 has a temperature-sensitive resistive element circuit 226 and a resistor 227 connected between the output terminal and ground potential, the resistance of the temperature-sensitive resistive element circuit 226 being variable according to temperature changes, and the resistor having a fixed resistance. The voltage applied to the resistor 227, is input as a feedback voltage $V_{fb}$, to a power control circuit 222 for controlling the on-off periods of the transistor 221. The resistor having a fixed resistance may comprise a single resistor or plural resistors connected in parallel or in series.

The power control circuit 222 comprises, e.g., a PWM circuit, which outputs a pulse to the transistor 221, the pulse having a pulse width varying according to the value of the feedback voltage $V_{fb}$. The PWM circuit includes, e.g., a triangular-wave generator, and a comparator wherein a triangular wave generated by the triangular-wave generator is employed as the input voltage, and the feedback voltage $V_{fb}$ is employed as the reference voltage. For this reason, the feedback voltage $V_{fb}$ is occasionally referred to as the reference voltage $V_{ref}$ in Description. The PWM circuit extends the on-period of a pulse signal so as to extend the on-period of the transistor 221 to increase the value of the feedback voltage $V_{fb}$ when the value of the feedback voltage $V_{fb}$ decreases. Additionally, the PWM circuit shortens the on-period of a pulse signal so as to shorten the on-period of the transistor 221 to decrease the value of the feedback voltage $V_{fb}$ when the value of the feedback voltage $V_{fb}$ increases. Thus, the output of the comparator is applied to the gate of the transistor 221.

The temperature-sensitive resistive element circuit 226 comprises a circuit employing at least two thermistors as temperature-sensitive resistive elements. The thermistors function as temperature sensors for detecting the temperature of the organic EL panel 1 since the data electrode driver 21 is equipped in the vicinity of the organic EL panel 1. The temperature-sensitive resistive element circuit 226 may be removed from the power circuit 22 and be equipped in a location closer to the organic EL panel 1 or on the organic EL panel 1. The temperature-sensitive resistive element circuit 226 is one that is equipped between the output side of the switching regulator and ground potential in order to determine the output voltage of the switching regulator.

The resistance of the temperature-sensitive resistive element circuit 226 varies according to changes in the resistance of the thermistors caused by the temperature changes. The turn-on period and the turn-off period of the transistor 221 are determined by the feedback voltage $V_{fb}$, which is a voltage obtained by dividing the output voltage by the temperature-sensitive resistive element circuit 226 and the resistor 227. When the temperature increases to lower the resistance of the temperature-sensitive resistive element circuit 226, the value of the feedback voltage $V_{fb}$ increases to shorten the turn-off period of the transistor 221 and extend the turn-off period of the transistor. This is because the resistance of the resistor 227 is relatively increased in comparison with the resistance of the temperature-sensitive resistive element circuit 226 (there is no change in the absolute value of the resistance of the resistor). As a result, the output voltage (i.e., $V_{SEG}$) lowers. As the output voltage lowers, the voltage applied to the resistor 227 (i.e., the feedback voltage $V_{fb}$) lowers, finally reaches the value before temperature changes and keeps that value. In other words, when the resistance of the temperature sensitive resistive element circuit 226 is lowered because of temperature rise, the output voltage of the transistor 221 (i.e., $V_{SEG}$) is lowered in order to keep the value of the feedback voltage $V_{fb}$ constant. Conversely, when the resistance of the temperature-sensitive resistive element circuit 226 is increased because of temperature drop, the output voltage of the transistor 221 (i.e., $V_{SEG}$) is increased in order to keep the value of the feedback voltage $V_{fb}$ constant.

By configuring the temperature-sensitive resistive element circuit 226 to change the supply voltage $V_{SEG}$ as shown in the solid curve in FIG. 1, it is possible to gradually decrease the supply voltage $V_{SEG}$ in substantially the same degree as the gradual decrease in the driving voltage in the normal temperature range, to decrease, according to temperature rise, the supply voltage $V_{SEG}$ in a substantially higher degree in the high temperature range than the gradual decrease in the supply voltage $V_{SEG}$ in the normal temperature range, and to gradually increase the supply voltage $V_{SEG}$ according to temperature drop in the low temperature range, having a breakdown voltage of 20 V as a limit.

Figure 4:
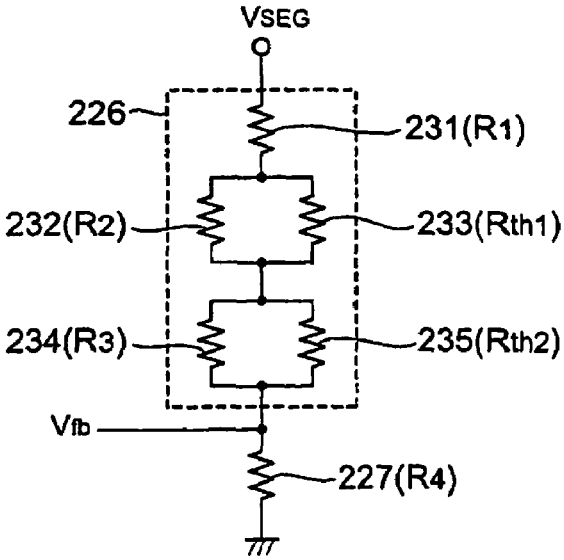
FIG. 4 is a circuit diagram showing an example of the structure of the temperature-sensitive resistive element circuit according to a first embodiment of the present invention.

FIG. 4 is a circuit diagram showing an example of the structure of the temperature-sensitive resistive element circuit 226. In the structure shown in FIG. 4, the temperature-sensitive resistive element circuit 226 is configured to have a resistor 231 having a fixed resistance, a parallel combination of a resistor 232 having a fixed resistance and a first thermistor 233, and a parallel combination of a resistor 234 having a fixed resistance and a second thermistor 235 connected in series with one another between the output voltage side and the resistor 227 in this order from the output voltage side. In FIG. 4, the bracketed reference accompanying each reference numeral designates a resistance.

Figure 5:
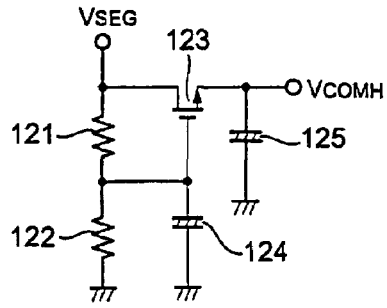
FIG. 5 is a circuit diagram showing an example of the structure of the supply circuit on a scanning electrode driver side.

FIG. 5 is a circuit diagram showing an example of the structure of the supply circuit 12 on the side of the scanning electrode driver 11. In the circuit shown in FIG. 5, the supply voltage $V_{SEG}$, which is supplied from the supply circuit 22 on the side of the data electrode driver 21, is divided by resistors 121 and 122, a voltage thus divided is provided to the gate of a transistor 123 through a capacitor 124, and a voltage, which has been reduced from the supply voltage $V_{SEG}$ by a certain value, appears on the output side. The output voltage that is taken out through an output capacitor 125 serves as the non-selection voltage $V_{COMH}$. Although the non-selection voltage $V_{COMH}$ varies, according to temperature changes, on a curve along the solid curve representing the supply voltage $V_{SEG}$ in FIG. 1, the non-selection voltage $V_{COMH}$ is lowered according to temperature rise as in the supply voltage $V_{SEG}$. By lowering the non-selection voltage $V_{COMH}$ according to temperature rise, it is possible to prevent an organic EL element from emitting light in a non-selection period (when the non-selection voltage $V_{COMH}$ is applied to the relevant scanning electrode 10) because of a reduction in the turn-on-voltage of the organic EL element caused by an increase in the ambient temperature.

In this embodiment, the resistances $R_1$, $R_2$, $R_3$ and $R_4$ of the resistors 231, 232, 234 and 227, the constants of the thermistors 233 and 235, and the reference voltage $V_{ref}$ (having the same meaning of the feedback voltage $V_{fb}$) in the temperature-sensitive resistive element circuit 226 shown in FIG. 4 are selected as shown in Table 1.

TABLE 1

| | |
|---|---|
| $V_{ref}$ | 1.23 (V) |
| $R_1$ | 68 (kΩ) |
| $R_2$ | 60 (kΩ) |
| $R_3$ | 90 (kΩ) |
| $R_4$ | 14.2 (kΩ) |
| Reference resistance of first thermistor | 800 (kΩ) |
| B constant of first thermistor | 4,700 (K) |
| Reference resistance of second thermistor | 700 (kΩ) |
| B constant of second thermistor | 4,700 (K) |

The resistance $R_{th}$ of each of the thermistors is expressed as formula (1)

$$R_{th}=R_o\times\exp\,[B(1/T-1/To)] \quad (1)$$

In formula (1), $R_o$ designates a reference resistance, B designates the B constant (thermistor constant) of a thermistor, and $R_o$ designates the resistance at a reference temperature $T_o$ (reference resistance). The reference temperature $T_o$ is 297K. T designates an ambient temperature of the organic EL panel 1. When the temperature sensitive resistive element circuit 226 is configured as shown in FIG. 4, and when the resistances $R_1$, $R_2$, $R_3$ and $R_4$ of the resistors 231, 232, 234 and 227, and the constants of the thermistors 233 and 235 are selected as shown in Table 1, the resistances $R_{th1}$ and $R_{th2}$ of the thermistors 233 and 235, and the supply voltage $V_{SEG}$ as the output voltage of the supply circuit 22 are shown in Table 2. In Table 2, the driving voltage of each of the organic EL elements, a supposed supply voltage having a higher value than the driving voltage by 6 V, and the non-selection voltage $V_{COMH}$ are also shown.

TABLE 2

| T (° C.) | Driving voltage (V) | Supposed supply voltage (V) | $R_{th1}$ (kΩ) | $R_{th2}$ (kΩ) | Supply voltage (V) | $V_{COMH}$ (V) | Supply voltage − driving voltage |
|---|---|---|---|---|---|---|---|
| −30 | 17.2 | 23.20 | 28292.9 | 24756.3 | 20.1 | 17.04 | 2.9 |
| −20 | 16.5 | 22.50 | 13184.6 | 11536.5 | 20.0 | 17.01 | 3.5 |
| 0 | 14.9 | 20.90 | 3386.0 | 2962.7 | 19.8 | 16.81 | 4.9 |
| 25 | 13.0 | 19.00 | 800.0 | 700.0 | 18.9 | 16.02 | 5.9 |
| 50 | 11.2 | 17.20 | 236.3 | 206.5 | 16.7 | 14.17 | 5.5 |
| 70 | 9.5 | 15.50 | 101.2 | 88.6 | 14.2 | 12.10 | 4.7 |
| 85 | 8.3 | 14.30 | 57.0 | 49.9 | 12.4 | 10.56 | 4.1 |

Figure 6:
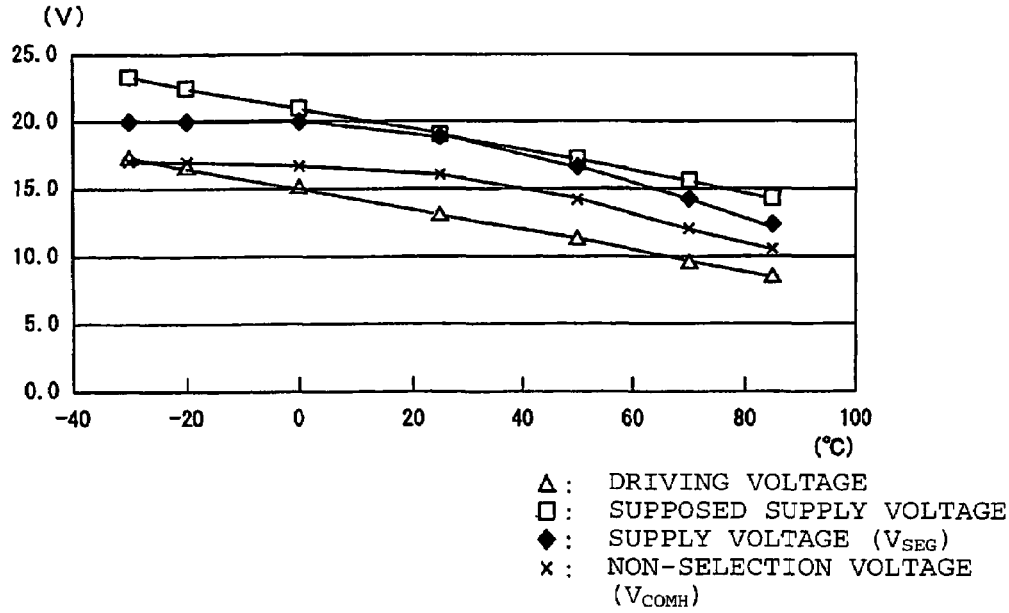
FIG. 6 is a schematic view showing changes in the supply voltage $V_{SEG}$ according to the first embodiment.

The respective values shown in Table 2 are graphically shown in FIG. 6. In FIG. 6, the horizontal axis represents a temperature (° C.), and the vertical axis represents a voltage (V). As shown in FIG. 6, in the normal temperature range, the supply voltage $V_{SEG}$ can be gradually decreased in substantially the same degree as the gradual decrease in the driving voltage, and the difference between the supply voltage $V_{SEG}$ and the driving voltage can be maintained at about 6 V (higher than the margin value for supply source). In the high temperature range, the supply voltage $V_{SEG}$ can be reduced, according to temperature rise, in a higher degree than the gradual decrease in the supply voltage $V_{SEG}$ in the normal temperature range. Additionally, in the low temperature range, the supply voltage $V_{SEG}$ can be gradually increased according to temperature drop, having a breakdown voltage of 20 V as a limit. Thus, it is possible to realize a driving device, which is capable of minimizing the occurrence of cross-talk in comparison with a case wherein the supply voltage $V_{SEG}$ is controlled according to temperatures of the organic EL panel 1 as indicated by the dotted curve in FIG. 1 while preventing the temperature of the driving circuit from being beyond the maximum permissible temperature at a high temperature. It is also possible to minimize the occurrence of cross-talk in comparison with a case wherein the supply voltage $V_{SEG}$ is controlled as indicated by the dotted curve in FIG. 1 while preventing the supply voltage $V_{SEG}$ from being beyond the breakdown voltage of the driving circuit at a low temperature.

Second Embodiment

Figure 7:
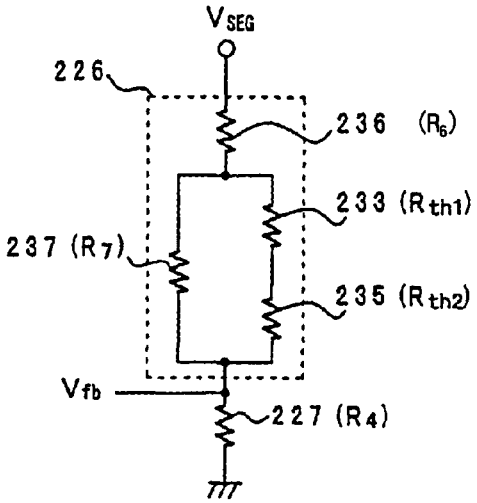
FIG. 7 is a circuit diagram showing an example of the structure of the temperature sensitive resistive element circuit according to a second embodiment of the present invention.

Although the temperature-sensitive resistive element circuit 226 is configured as shown in FIG. 4 in the first embodiment, the temperature-sensitive resistive element circuit 226 employing thermistors as at least two temperature-sensitive resistive elements is not limited to the circuit shown in FIG. 4. FIG. 7 is a circuit diagram showing another example of the structure of the temperature sensitive resistive element circuit 226.

In the structure shown in FIG. 7, the temperature-sensitive resistive element circuit 226 is configured to have a resistor 236 and a circuit comprising a first thermistor 233, a second thermistor 235 and a resistor 237 having a fixed resistance, connected in series with each other between the output voltage side and the resistor 227 in this order from the output voltage side. The circuit comprising the first thermistor 233, the second thermistor 235 and the resistor 237 has the resistor 237 having a fixed resistance and a series combination of the first thermistor 233 and the second thermistor 235, connected in parallel with each other. In FIG. 7, the bracketed reference accompanying each reference numeral represents a resistance. Each of the resistors having a fixed resistance may comprise a single resistor, a parallel combination of plural resistors or a series combination of plural resistors.

In this embodiment, the resistances $R_6$, $R_7$ and $R_4$ of the resistors 236, 237 and 227, the constants of the thermistors 233 and 235, and the reference voltage $V_{ref}$ in the temperature-sensitive resistive element circuit 226 shown in FIG. 7 are selected as shown in Table 3. The reference temperature $T_o$ is 297K.

TABLE 3

| | |
|---|---|
| $V_{ref}$ | 1.23 (V) |
| $R_6$ | 68 (kΩ) |
| $R_7$ | 70 (kΩ) |
| $R_4$ | 9.1 (kΩ) |
| Reference resistance of first thermistor | 400 (kΩ) |
| B constant of first thermistor | 4,700 (K) |
| Reference resistance of second thermistor | 800 (kΩ) |
| B constant of second thermistor | 12,000 (K) |

When the resistances $R_6$, $R_7$ and $R_4$ of the resistors 236, 237 and 227, and the constants of the thermistors 233 and 235 are selected as shown in Table 3, the resistances $R_{th1}$ and $R_{th2}$ of the thermistors 233 and 235, and the supply voltage $V_{SEG}$ as the output voltage of the supply circuit 12 are shown in Table 4. In Table 4, the driving voltage of each of the organic EL elements, a supposed supply voltage having a higher value than the driving voltage by 4 V, and the non-selection voltage $V_{COMH}$ are also shown. In this embodiment, the margin value for supply source is estimated as 4 V.

TABLE 4

| T (° C.) | Driving voltage (V) | Supposed supply voltage (V) | $R_{th1}$ (kΩ) | $R_{th2}$ (kΩ) | Supply voltage (V) | $V_{COMH}$ (V) | Supply voltage − driving voltage |
|---|---|---|---|---|---|---|---|
| −20 | 17.5 | 21.50 | 6592.3 | $23752 \times 10^3$ | 19.9 | 17.29 | 2.4 |
| 0 | 15.9 | 19.90 | 1693.0 | 31835.0 | 19.9 | 17.27 | 4.0 |
| 25 | 14.0 | 18.00 | 400.0 | 800.0 | 19.4 | 16.84 | 5.4 |
| 50 | 12.3 | 16.30 | 118.1 | 35.4 | 16.9 | 14.71 | 4.6 |
| 70 | 10.5 | 14.50 | 50.6 | 4.1 | 14.6 | 12.67 | 4.1 |

Figure 8:
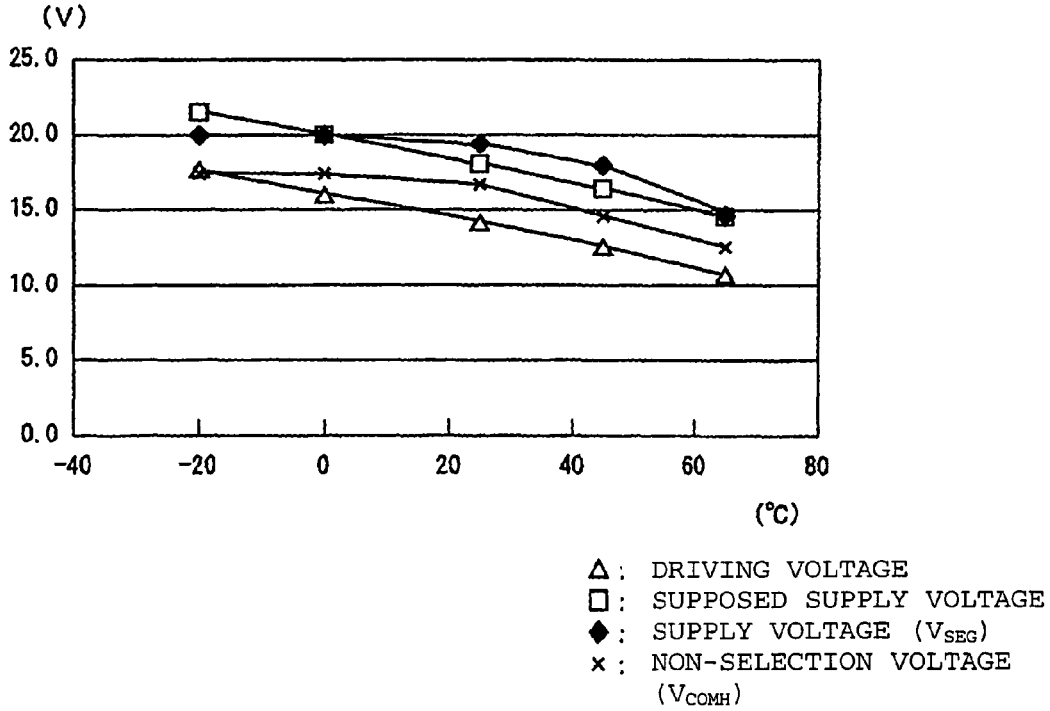
FIG. 8 is a schematic view showing changes in the supply voltage $V_{SEG}$ according to the second embodiment.

The respective values shown in Table 4 are graphically shown in FIG. 8 as an explanatory diagram. In FIG. 8, the horizontal axis represents a temperature (° C.), and the vertical axis represents a voltage (V). As shown in FIG. 8, in the normal temperature range, not only the supply voltage $V_{SEG}$ can be gradually decreased in substantially the same degree as the gradual decrease in the driving voltage, and the difference between the supply voltage $V_{SEG}$ and the driving voltage can be maintained at 4 V or higher. In the high temperature range, the supply voltage $V_{SEG}$ can be reduced, according to temperature rise, in a higher degree than the gradual decrease in the supply voltage $V_{SEG}$ in the normal temperature range. Additionally, in the low temperature range, the supply voltage $V_{SEG}$ can be gradually increased according to temperature drop, having a breakdown voltage of 20 V as a limit. Thus, it is possible to realize a driving device, which is capable of minimizing the occurrence of cross-talk in comparison with a case wherein the supply voltage $V_{SEG}$ is controlled according to temperatures of the organic EL panel 1 as indicated by the dotted curve in FIG. 1 while preventing the temperature of the driving circuit from being beyond the maximum permissible temperature at a high temperature. It is also possible to minimize the occurrence of cross-talk in comparison with a case wherein the supply voltage $V_{SEG}$ is controlled as indicated by the dotted curve in FIG. 1 while preventing the supply voltage $V_{SEG}$ from being beyond the breakdown voltage of the driving circuit at a low temperature.

In each of the embodiments stated earlier, the temperature-sensitive resistive element circuit 226 employs the two thermistors 233 and 235. The temperature-sensitive resistive element circuit 226 may employs more than two thermistors so that the difference between the supply voltage $V_{SEG}$ and the driving voltage is maintained at a value close to the margin value for supply source in the low temperature range and so that the curve, which represents changes in the supply voltage $V_{SEG}$ according to temperatures in order to prevent malfunction or breakdown of a driver IC in the low temperature range and the high temperature range, can be more finely controlled.

Third Embodiment

Figure 9:
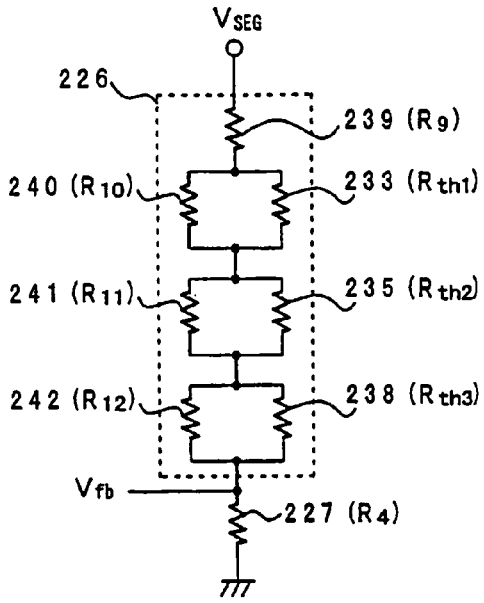
FIG. 9 is a circuit diagram showing an example of the structure of the temperature sensitive resistive element circuit according to a third embodiment of the present invention.

FIG. 9 is a circuit diagram showing an example of the structure of the temperature-sensitive resistive element circuit 226 in a case wherein three thermistors are employed. In the structure shown in FIG. 9, the temperature-sensitive resistive element circuit 226 is configured to have a resistor 239 having a fixed resistance, a parallel combination of a resistor 240 having a fixed resistors and a first thermistor 233, a parallel combination of a resistor 241 having a fixed resistance and a second thermistor 235, and a parallel combination of a resistor 242 having a fixed resistance and a third thermistor 238, connected in series with one another between the output voltage side and the resistor 227 in this order from the output voltage side. In FIG. 9, the bracketed reference companying each reference numeral designates a resistance. The respective resistors having a fixed resistance may comprise a single resistor, a parallel combination of plural resistors or a series combination of plural resistors.

In this embodiment, the references $R_9$, $R_{10}$, $R_{11}$ and $R_{12}$ of the resistors 239, 240, 241 and 242, the constants of the thermistors 233, 235 and 238, and the reference voltage $V_{ref}$ in the temperature-sensitive resistive element circuit 226 shown in FIG. 9 are selected as shown in Table 5. The reference temperature $T_o$ is 297K.

TABLE 5

| | |
|---|---|
| $V_{ref}$ | 1.23 (V) |
| $R_9$ | 10 (kΩ) |
| $R_{10}$ | 50 (kΩ) |
| $R_{11}$ | 85 (kΩ) |
| $R_{12}$ | 100 (kΩ) |
| $R_4$ | 16 (kΩ) |

TABLE 5-continued

| | |
|---|---|
| Reference resistance of first thermistor | 1,400 (kΩ) |
| B constant of first thermistor | 4,700 (K) |
| Reference resistance of second thermistor | 1,000 (kΩ) |
| B constant of second thermistor | 4,700 (K) |
| Reference resistance of third thermistor | 1,200 (kΩ) |
| B constant of third thermistor | 4,700 (K) |

When the resistances $R_9$, $R_{10}$, $R_{11}$ and $R_{12}$ of the resistors 239, 240, 241 and 242, and the constants of the thermistors 233, 235 and 238 are selected as shown in Table 5, the resistances $R_{th1}$, $R_{th2}$ and $R_{th3}$ of the thermistors 233, 235 and 238, and the supply voltage $V_{SEG}$ as the output voltage of the supply circuit 12 are shown in Table 6. In Table 6, the driving voltage of each of the organic EL elements, a supposed supply voltage having a higher value than the driving voltage by 6 V, and the non-selection voltage $V_{COMH}$ are also shown. In this embodiment, the margin value for supply source is estimated as 6 V.

TABLE 6

| T (° C.) | Driving voltage (V) | Supposed supply voltage (V) | $R_{th1}$ (kΩ) | $R_{th2}$ (kΩ) | $R_{th3}$ (kΩ) | Supply voltage (V) | $V_{COMH}$ (V) | Supply voltage − driving voltage |
|---|---|---|---|---|---|---|---|---|
| −30 | 17.2 | 23.20 | 49513 | 35366 | 42439 | 20.0 | 17.00 | 2.8 |
| −20 | 16.5 | 22.50 | 23073 | 16481 | 19777 | 20.0 | 16.97 | 3.5 |
| 0 | 14.9 | 20.90 | 5925 | 4232 | 5079 | 19.8 | 16.77 | 4.9 |
| 25 | 13.0 | 19.00 | 1400.0 | 1000.0 | 1200.0 | 18.8 | 15.99 | 5.8 |
| 50 | 11.2 | 17.20 | 413.5 | 295.0 | 354.4 | 16.5 | 14.01 | 5.3 |
| 70 | 9.5 | 15.50 | 177.1 | 126.5 | 151.8 | 13.5 | 11.50 | 4.0 |
| 80 | 8.3 | 14.30 | 99.8 | 71.3 | 85.6 | 11.1 | 9.41 | 2.8 |

Figure 10:
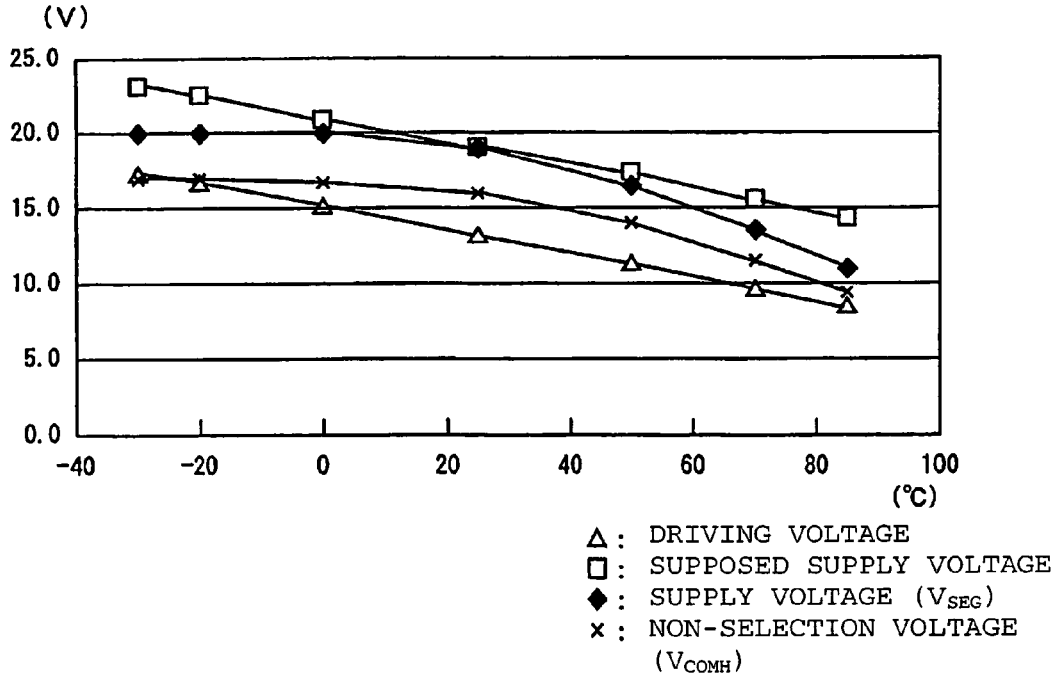
FIG. 10 is a schematic view showing changes in the supply voltage $V_{SEG}$ according to the third embodiment.

The respective values shown in Table 6 are graphically shown in FIG. 10 as an explanatory diagram. In FIG. 10, the horizontal axis represents a temperature (° C.), and the vertical axis represents a voltage (V). As shown in FIG. 10, in the normal temperature range, the supply voltage $V_{SEG}$ can be gradually decreased in substantially the same degree as the gradual decrease in the driving voltage, and the difference between the supply voltage $V_{SEG}$ and the driving voltage can be maintained at about 6 V. Additionally, in the high temperature range, the supply voltage $V_{SEG}$ can be decreased, according to temperature rise, in a higher degree than the gradual decrease in the supply voltage $V_{SEG}$ in the normal temperature range. Further, in the low temperature range, the supply voltage $V_{SEG}$ can be gradually increased according to temperature drop, having a breakdown voltage of 20 V as a limit.

The entire disclosure of Japanese Patent Application No. 2004-134107 filed on Apr. 28, 2004 including specification, claims, drawings and summary is incorporated herein by reference in its entirety.

What is claimed is:

1. A method for driving an organic EL display device, comprising:

employing an organic EL panel including scanning electrodes and data electrodes so as to have a matrix pattern, the organic EL panel having an organic EL element sandwiched between a scanning electrode and a data electrode; setting a selected scanning electrode at a potential in a selection period; setting a non-selected scanning electrode at a potential in a non-selection period; and flowing a constant current from a data electrode driver into a data electrode containing a pixel to emit light;

setting a voltage value of a supply voltage at a higher value than a driving voltage of the organic EL element by a margin value for power source, and changing the voltage value of the supply voltage according to changes in the driving voltage caused by changes in an ambient temperature of the organic EL panel, the power supply being supplied to the data electrode data driver, in a case wherein the ambient temperature is in an intermediate temperature range; and setting the voltage value of the supply voltage so as to have a smaller difference between the supply voltage and the driving voltage than that in the intermediate temperature range, and changing the voltage value of the supply voltage in a higher degree than a changing degree in the supply voltage caused by the changes in the ambient temperature in the intermediate temperature range in a case wherein the ambient temperature is in a high temperature range which is higher than the intermediate temperature range.

2. The method according to claim 1, further comprising controlling the voltage value of the supply voltage so as to gradually increase as the ambient temperature decreases and to prevent the voltage value of the supply voltage from further increasing when reaching a lower value than a breakdown voltage of the data electrode driver in a case wherein the ambient temperature is in a low temperature range which is lower than the intermediate temperature range.

3. The method according to claim 2, further comprising setting a boundary between the intermediate temperature range and the low temperature range in a range from −10 to +20° C.

4. The method according to claim 1, further comprising setting a boundary between the intermediate temperature range and the high temperature range in a range from +40 to +70° C.

5. A device for driving an organic EL display device, wherein an organic EL panel including scanning electrodes and data electrodes disposed so as to have a matrix pattern is employed so as to have an organic EL element sandwiched between a scanning electrode and a data electrode, a selected scanning electrode is set at a potential in a selection period, a non-selected scanning electrode is set at a potential in a non-selection period, and a constant current is flowed from a data electrode driver into a data electrode containing a pixel to emit light;

comprising a supply circuit, which employs a temperature-sensitive element circuit including at least two temperature-sensitive resistive elements having a resistance varying according to temperatures, and which provides the data electrode driver with a supply voltage, the supply voltage being generated so as to have a higher voltage value than a driving voltage of the organic EL element by a margin value for supply source and being changed according to variations in the driving voltage caused by changes in an ambient temperature of the organic EL element in a case wherein the ambient temperature is in an intermediate temperature range, and the supply voltage being generated so as to have the voltage value set at a smaller difference between the supply voltage and the driving voltage than that in the intermediate temperature range and have the voltage value changed in a higher degree than a changing degree in the supply voltage caused by the changes in the ambient temperature in the intermediate temperature range in a case wherein the ambient temperature is in a high temperature range which is higher than the intermediate temperature range.

6. The device according to claim 5, wherein the supply circuit is configured to gradually increase the voltage value of the supply voltage as the ambient temperature decreases and to prevent the voltage value of the supply voltage from further increasing when reaching a lower value than a breakdown voltage of the data electrode driver, the voltage value of the supply voltage being supplied to the data electrode driver, in a case wherein the organic EL panel has an ambient temperature in a low temperature range which is lower than the intermediate temperature range.

7. The device according to claim 5, wherein the supply circuit further comprises a regulator circuit, which outputs the supply voltage supplied to the data electrode driver; and wherein the temperature-sensitive resistive element circuit is disposed between an output side of the regulator circuit and a reference potential of the regulator circuit in order to determine an output voltage of the regulator circuit.

8. The device according to claim 7, wherein a series combination of the temperature-sensitive resistive element circuit and a resistor having a fixed resistance is disposed between an output side of a switching regulator circuit as the regulator circuit and ground potential; and wherein the temperature-sensitive resistive element circuit comprises a resistor having a fixed resistance, and at least two parallel combinations of a resister having a fixed resistance and a temperature-sensitive resistive element, connected in series with one another.

* * * * *